US006799985B2

(12) United States Patent
Uchida et al.

(10) Patent No.: US 6,799,985 B2
(45) Date of Patent: Oct. 5, 2004

(54) SELF-LOCATING CONNECTOR ASSEMBLY

(75) Inventors: Takashi Uchida, Tokorozawa (JP); Toshio Ohashi, Sano (JP); Hideki Yoshida, Ashikaga (JP); Nozomi Ito, Ageo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/383,507

(22) Filed: Mar. 10, 2003

(65) Prior Publication Data

US 2003/0171018 A1 Sep. 11, 2003

(30) Foreign Application Priority Data

Mar. 11, 2002 (JP) ..... 2002-065537

(51) Int. Cl.[7] ..... H01R 13/645
(52) U.S. Cl. ..... 439/246
(58) Field of Search ..... 439/157, 372, 439/246, 248, 249

(56) References Cited

U.S. PATENT DOCUMENTS 5,325,263 A 6/1994 Singer et al.
5,904,584 A 5/1999 Flask et al.
6,045,377 A * 4/2000 Kajiura ..... 439/159
6,264,485 B1 * 7/2001 Saka et al. ..... 439/157
6,371,778 B1 * 4/2002 Watanabe ..... 439/157
2002/0013072 A1 1/2002 Hattori et al.

FOREIGN PATENT DOCUMENTS

JP 9-259975 A 10/1997

* cited by examiner

*Primary Examiner*—Renee Luebke
(74) *Attorney, Agent, or Firm*—Foley & Lardner LLP

(57) ABSTRACT

The self-locating connector assembly includes a first connector receiving one of internal and external terminals. The assembly includes a second connector receiving the other one of external and internal terminals. The assembly includes a locator for slidably inserting first connector thereinto in an axial direction of the internal and external terminals. Respecting one of the first connector and the second connector are slidably locked with corresponding one of supporting members vertically and horizontally. Before the first and second connectors are mated with each other, the first and second connectors automatically correct a displacement between axes thereof. The first connector includes a recess, the recess including an oblique face for facilitating to mate with the second connector, the recess including at least a pair of parallel faces with an axial dimension and joined to the oblique face. The second connector includes a parallel face corresponding to the recess of the first connector. During mating operation of the first connector and the second connector, parallel faces of the first connector and the second connector automatically corrects the displacement before the internal and external terminals are mated with each other.

11 Claims, 11 Drawing Sheets

SELF-LOCATING CONNECTOR ASSEMBLY

BACKGROUND OF THE INVENTION

The present invention relates to a connector assembly adapted for electric connection of electric equipment, and more particularly to a locating connector fixed to a modular instrument loaded on an automobile.

The automobile includes an instrumental panel having a meter, audio equipment and an air conditioner or electric equipment housed below the instrumental panel. An instrumental harness (referred to as inst-harness) is arranged in the panel and the electric equipment. A body-harness is arranged in a vehicle body. The inst-harness and the body-harness are interconnected by a self-locating connector. This connector is disclosed in, for example Japanese Patent Application Laid-Open No. 9-259975.

A tool is fitted in a rotation operation part of a rotary screw of one connector. Before one connector is pushed into the other connector, highly accurate locating must be carried out for the connectors. However, elastic deformation of the harness connected to the connector generates undue moment and tensile stress. These forces displace an axis of the connector, which makes smooth pushing-in or rotating work by the tool difficult. The displacement applies an abnormal load on a terminal hence bending it. Thus, the displacement necessitates correction of the axis.

SUMMARY OF THE INVENTION

The present invention is directed to a locating connector used for a modular instrument. This connector has high connection workability and connection reliability without any correction of an axis during mating of internal and external terminals.

The first aspect of the invention is directed to a self-locating connector assembly. The assembly includes a first connector receiving one of internal and external terminals. The assembly includes a second connector receiving the other one of external and internal terminals. The assembly includes a locator for slidably inserting first connector thereinto in an axial direction of the internal and external terminals.

Respecting one of the first connector and the second connector are slidably locked with corresponding one of supporting members vertically and horizontally. Before the first and second connectors are mated with each other, the first and second connectors automatically correct a displacement between axes thereof. The first connector includes a recess, the recess including an oblique face for facilitating to mate with the second connector, the recess including at least a pair of parallel faces with an axial dimension and joined to the oblique face.

The second connector includes a parallel face corresponding to the recess of the first connector. During mating operation of the first connector and the second connector, parallel faces of the first connector and the second connector automatically corrects the displacement before the internal and external terminals are mated with each other.

Preferably, each of the supporting members is mounted to a vehicle body and a modular instrument. Automatic correction of the displacement is completed, with equipping of modular instrument on the vehicle body completed.

Preferably, the first connector includes a worm and a worm wheel. The second connector includes a guide pin. The first connector includes a cam channel for engaging with the guide pin to drive the first connector toward the second connector. Rotating of the worm and worm wheel allows the first connector and the second connector to be mated with each other.

Preferably, the first connector includes a guide pin. The second connector includes lock pin. The locator includes a lever rotatably supported thereto. The lever includes a first cam channel for engaging with the lock pin, and second cam channel for engaging with the guide pin. The lever with a handle operation allows the first connector and the second connector to be mated with each other.

Preferably, the first connector includes a connector housing. The locator includes a rotation operating part for rotating the worm. The locator includes a rotation stopping mechanism for stopping the worm wheel from rotating over a number of rotations. The mechanism includes a projection mounted to a rotation operating part. The mechanism includes a movable stopper mounted to the connector housing.

Preferably, the rotation operating part includes a torque limiter.

Preferably, the locator includes a guide plate integral therewith. The guide plate defines a hole in front of an internal terminal of the first connector for passing the internal terminal through the hole.

The second aspect of the invention is directed to the self-locating connector assembly. The assembly includes first and second connectors to be mated with each other. The assembly includes a locator receiving a first connector therein for guiding the second connector to be aligned with the first connector.

Preferably, the locator includes an end face inclined to an axis.

Preferably, the first connector is displacable within the locator. The locator includes a cam mechanism for approaching the first and second connectors to each other. The cam mechanism includes a base rotatably supported on the first connector about an axis and defining a cam. The cam mechanism includes a follower mounted to a second connector for being guided by the cam to approach the axis, as the base is rotated.

Preferably, the cam approaches the axis, as the cam travels from a starting point to a terminal point.

BRIEF DESCRIPTION OF THE ACCOMPANYING DRAWINGS

FIG. 4A illustrates a case before loading on the modular instrument (front faces of internal and external connectors are placed oppositely to each other), FIG. 4B a case of loading in a temporarily held state on the modular instrument, and FIG. 4C completion of connector mating.

FIG. 5A illustrates a case before connector mating, FIG. 5B a case after the connector mating, and FIG. 5C an arrow A view of FIG. 5A.

FIG. 8A is a sectional view during transmission of rotation, FIG. 8B a sectional view during nontransmission of rotation, FIG. 8C a sectional view along VIIIA—VIIIA of FIG. 8A, and FIG. 8D a sectional view along VIIID—VIIID of FIG. 8B.

FIG. 9A is a side sectional view of the connector, FIG. 9B a front view of the connector, and FIG. 9C a front view of the connector of FIG. 9A.

FIG. 10A is a front view of the connector, and FIG. 10B a side view of the connector.

DETAILED DESCRIPTION OF THE PREFERRED EMBODIMENTS

Embodiments of the present invention will hereby be described with reference to the drawings (First Embodiment)

Figure 1:
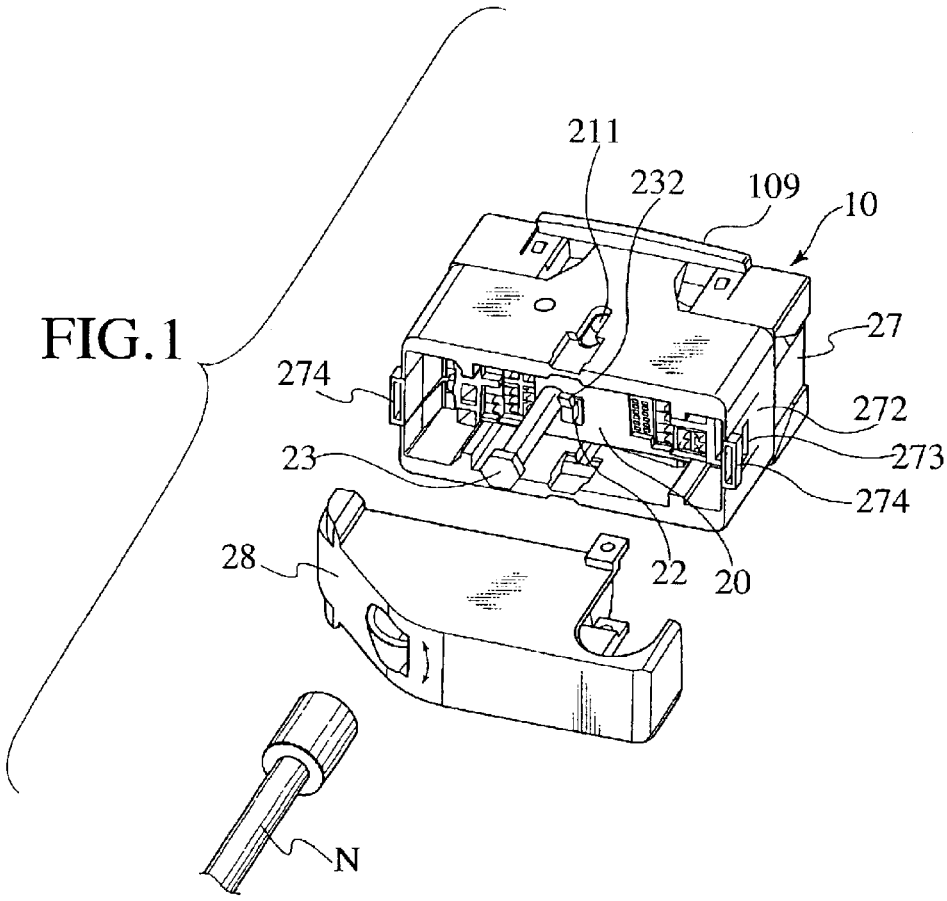
FIG. 1 is a perspective view illustrating a connector according to a first embodiment of the present invention.
Figure 2A:
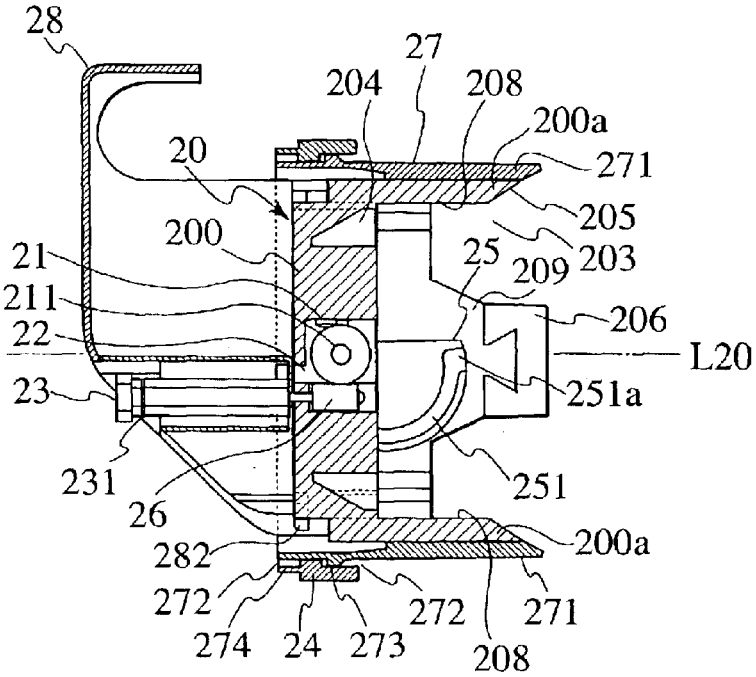
FIG. 2A is a side sectional view of the connector connected to a modular instrument in FIG. 1.
Figure 2B:
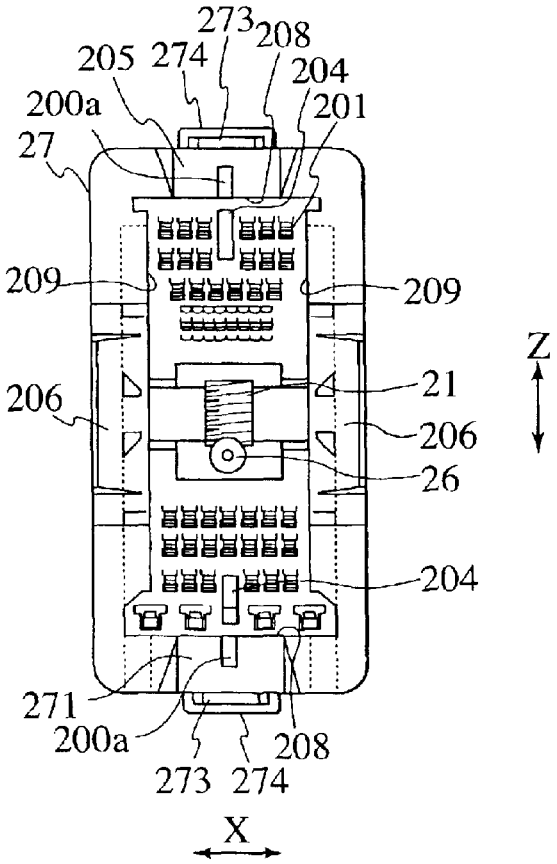
FIG. 2B is a front view of the connector.

In FIG. 1 and FIGS. 2A and 2B, connector 20 is incorporated in a modular instrument. The modular instrument includes components of an instrument panel, a meter, audio equipment and an air conditioner. Connector 20 is attached to the inside of locator 27 so as to slide in an axial direction of a terminal (hereinafter referred to as "axial direction").

Figure 3B:
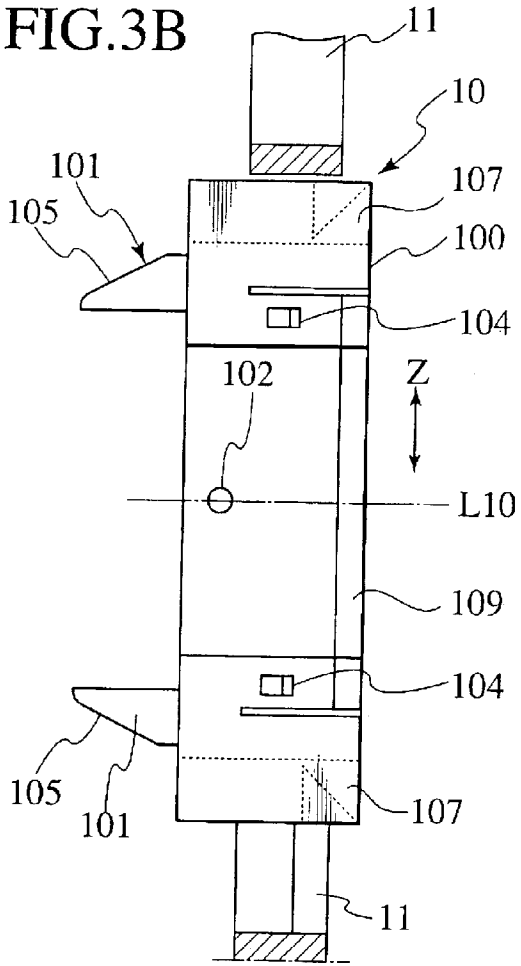
FIG. 3B is a side view of the connector.
Figure 3A:
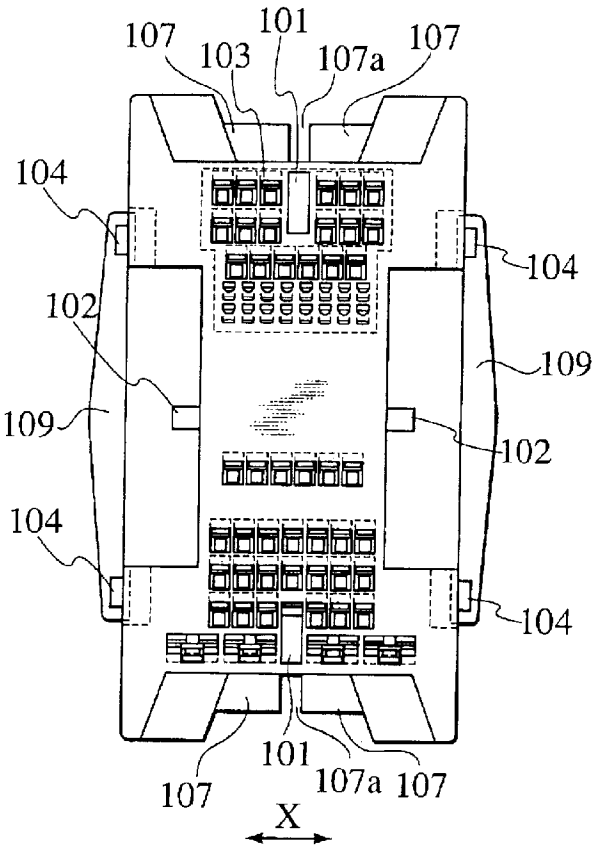
FIG. 3A is a front view of a connector connected to a vehicle body of FIG. 1.

Connector 20 includes housing 200. Locator 27 and the housing have ends 271 and 200*a* opposite connector 10 (FIGS. 3A and 3B). The ends have oblique faces 205, 206 inclined with respect to an axis line L20. Oblique faces 205, 206 facilitate mating with connector 10. Connected to oblique faces 205, 206, a pair of upper-lower and left-right parallel faces 208, 209 are extended in the axial direction. These parallel faces 208, 209 constitute recess 203 (hereinafter, in the drawings, a "Z direction" is a longitudinal direction and an "X direction" is a transverse direction).

Housing 200 receives a plurality of internal terminals (not illustrated). Housing 200 has a face opposite connector 10, which has recess 204 for receiving an auxiliary locating pin 101.

Connector 20 includes rotatable guide 25 having circular-arc cam channel 251.

Figure 4C:
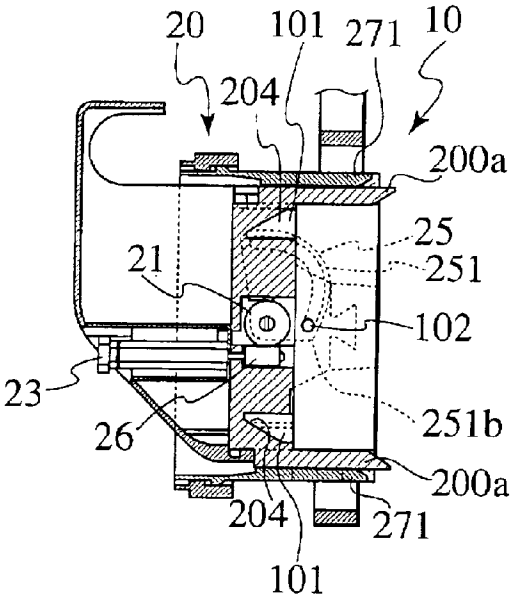
FIGS. 4A to 4C are illustrative views of mating operations of the connectors of FIGS. 1 and 3A.

Cam channel 251 has open end or starting point 251*a* and terminal end 251*b* (see FIG. 4C). Guide 25 has a rotational center, which is made eccentric from the circular-arc center of cam channel 251 toward terminal end 251*b*. Accordingly, each position of cam channel 251 approaches the rotational center from open end 251*a* toward terminal end 251*b*.

Connector 20 includes worm wheel 21 integrated with guide 25. Worm wheel 21 is fixed to shaft 211. Shaft 211 coincides with the rotational center. Both ends of shaft 211 are rotatably supported on housing main body 200. Worm wheel 21 is engaged with worm 26 fixed to the end of rotation operation part 23.

Locator 27 is fixed to frame-shaped connector bracket 24 as a support member of the modular instrument so as to slide in the transverse direction. Locator 27 includes end 271 inserted into bracket 24. Locator 27 includes flexible part 272 in a rear end. Flexible part 272 has locking pawl 273 and locating part 274, which fix locator 27 to bracket 24.

Resin harness cover 28 is fixed to housing 200. Cover 28 has hole 282, and it is locked with a projection on housing 200.

In FIGS. 3A and 3B, connector 10 is connected to a vehicle body. Connector 10 includes housing 100 having external terminal 103 received therein. Connector 10 has auxiliary locating pin 101 and lock pin 102 for mating of connectors 10, 20. Connector 10 is fixed to bracket 11 as a support member of the vehicle body so as to slide up and down.

Connector 10 includes locking pawl 104 for attachment to bracket 11 of the vehicle body. Connector 10 includes auxiliary locating pin 101, which has oblique face 105 inclined with respect to an axis line (L10) for locating during mating with connector 10 (20).

Connector 10 includes flanges 107 at the top and bottom. Flanges 107 have gaps therebetween. Connector 10 includes bridges 109 on the both sides.

Figure 4B:
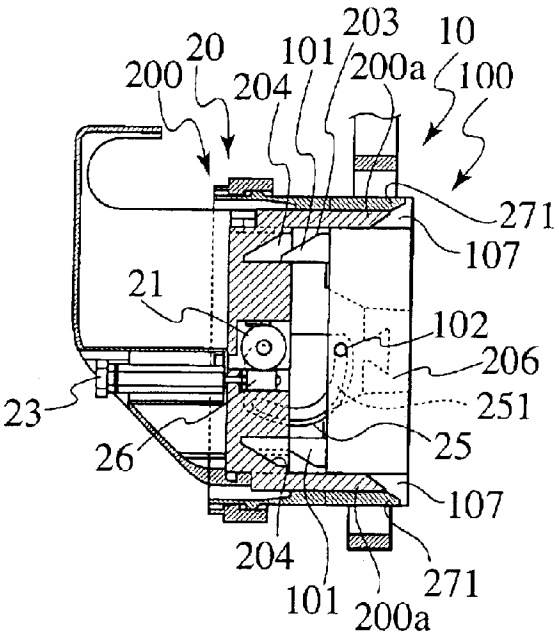
Figure 4A:
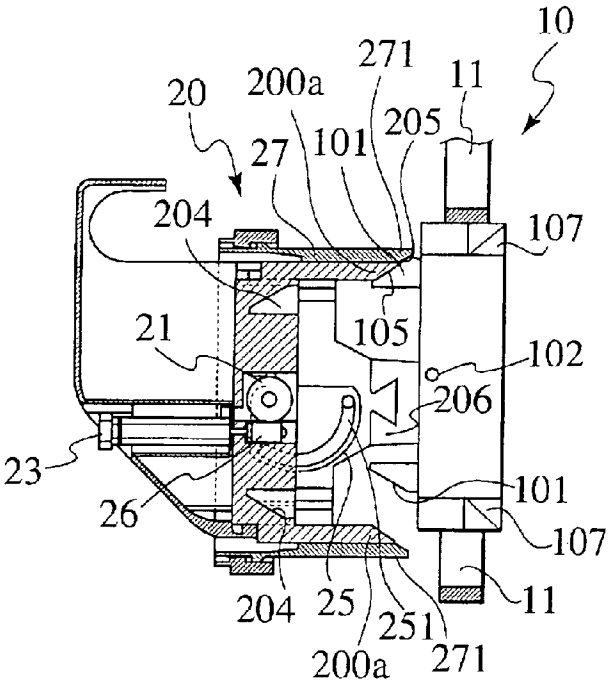

In FIG. 4A, before the modular instrument is loaded (attached) on the vehicle body, connectors 10, 20 are located, with the front faces thereof opposed each other. In this state, oblique face 105 of locating pin 101 is abutted on oblique face 205 of connector 20 and locator 27.

Next, in FIG. 4B, the modular instrument is pushed to the final position of the vehicle body. This pushing permits oblique face 105 of pin 101 to move along oblique face 205 of connector 20. This movement aligns connector 10 in a longitudinal direction with respect to bracket 11. Housing 100 is fitted in recess 203. Further, the pushing of the modular instrument into the vehicle body side starts mating of pin 101 in recess 204.

The side faces of connector 10 are fitted along oblique faces 206 of connector 20 and locator 27 in a transverse direction. Pin 102 enters the open end of groove 251 of guide 25. Flanges 107 abut against the ends 271 of locator 27. In this position, bracket 11 is abutted on the members of the modular instrument, and housing 100 and locator 27 are positionally restrained (not illustrated). In this position, the attaching of the modular instrument to the vehicle body is completed. The modular instrument is fixed to the vehicle body by appropriate means such as bolts or the like.

In FIG. 4B, rotation operation part 23 is rotated in a direction indicated at an insertion port of a socket wrench N of harness cover 28. The wrench N rotates worm 26. The worm 26 rotates worm wheel 21. In FIG. 4C, guide 25 is rotated integrally with worm wheel 21. Cam channel 251 guides pin 102 to its terminal end 102*b*. The ends 200*a* of connector housing 20 pass gaps 107*a* between flanges 107. A relative distance between pin 102 and worm wheel 21 is shortened. Thus, connector 10 is pulled towards connector 20, whereby connectors 10, 20 are completely mated together.

In FIG. 4B, the external and internal terminals in connectors 10, 20 are in a state before a start of mating. In a state where housing 100 is fitted in recess 203 of housing 200, the axial parallel faces with predetermined dimensions are mated to each other. A force by elastic deformation of the harness or tensile stress applies no undue moment on the external terminal. When an undue force is applied to connectors 10, 20 for alignment during loading on the modular instrument, no undue moment is applied to the internal and external terminals, and thus no terminal contact failures occur.

Figure 5A:
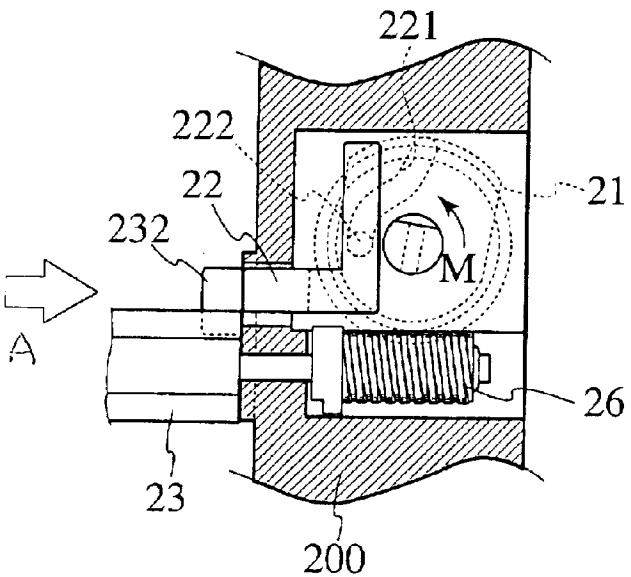
FIGS. 5A to 5C are operation illustrative views of an engagement gear and a stopper of FIG. 2A.
Figure 5B:
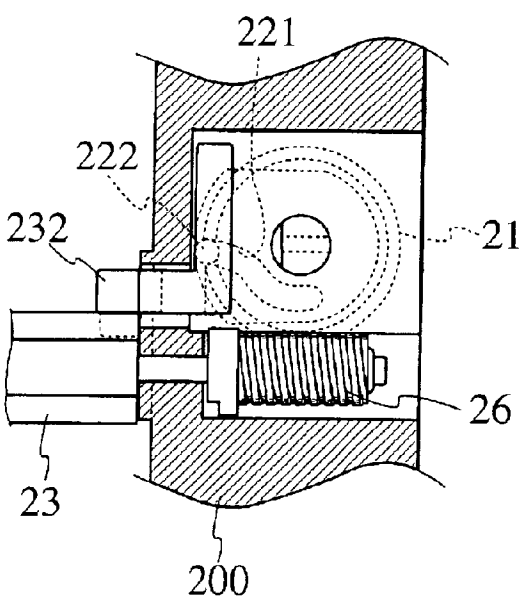
Figure 5C:
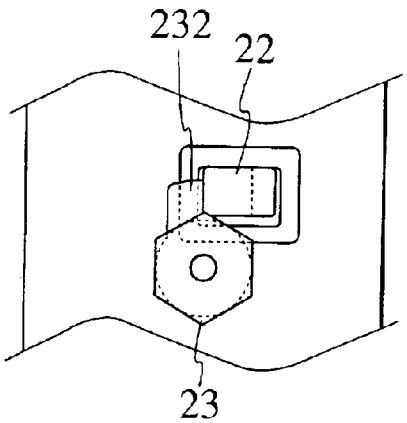

In FIG. 5A, L-shaped stopper 22 has a bottom surface, and cylindrical guide pin 222 is projected from this part. Pin 222 is engaged with stopper guide groove 221 of worm wheel 21.

Operation part 23 is rotated in order to engage connectors 10, 20 of FIG. 5A with each other. This rotation rotates worm wheel 21 left (M direction). Stopper 22 is guided towards the outside in a diameter direction of worm wheel 21 by groove 221 to project from housing 200. Stopper 22 is abutted on upper projection 232 of operation part 23. This abutment stops the rotation of operation part 23.

Four rotations of operation part 23 complete the engagement of connectors 10, 20 with each other. Stopper 22 starts projecting when the last fourth rotation is started. Stopper 22 projection is completed when the rotation comes to an end.

The rotation stop of operation part 23 eliminates an excessive force applied on worm 26 and worm wheel 21 to prevent damage of the respective portions 26 and 21. Operation part 23 includes destruction part 231 small in section. Destruction part 231 prevents damage of a dual structure.

Figure 6:
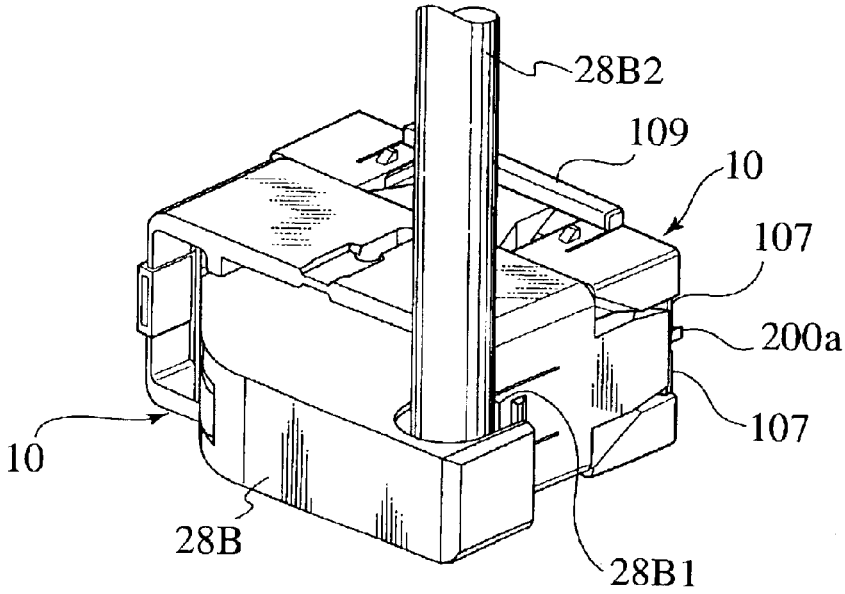
FIG. 6 is a perspective view illustrating a harness cover of a structure other than the structure of FIG. 1.
Figure 7:
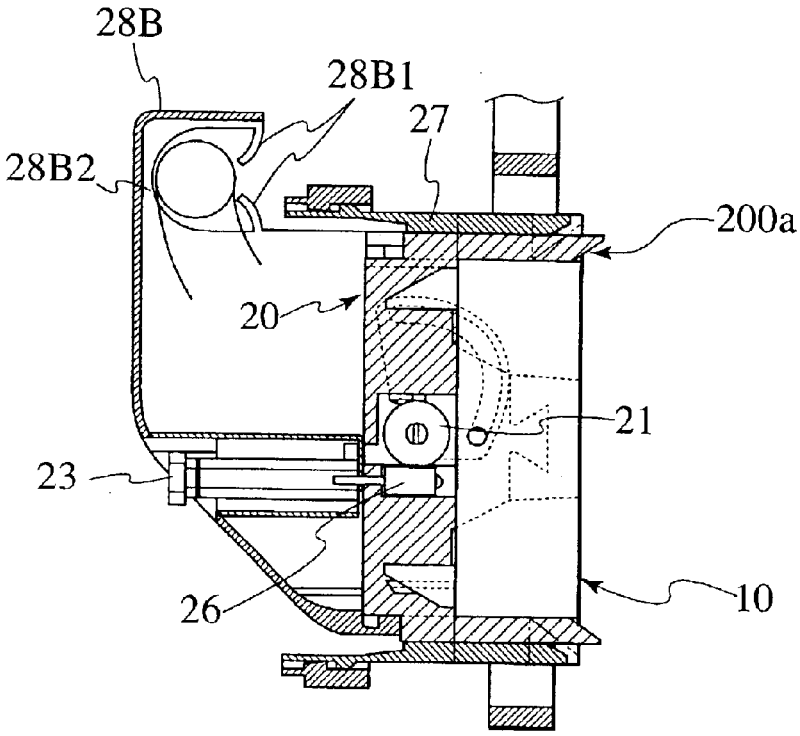
FIG. 7 is a plan sectional view of the harness cover of FIG. 6.

In FIGS. 6 and 7, harness cover 28B has a structure different from that of the first embodiment. Harness cover 28B includes integrally formed clamp 28B1. Clamp 28B1 holds and fixes harness 28B2, whereby the harness cover is streamlined.

A terminal of harness 28B2 has a terminal fixed by caulking. This terminal is connected to the internal terminal received in connector 20.

Figure 8A:
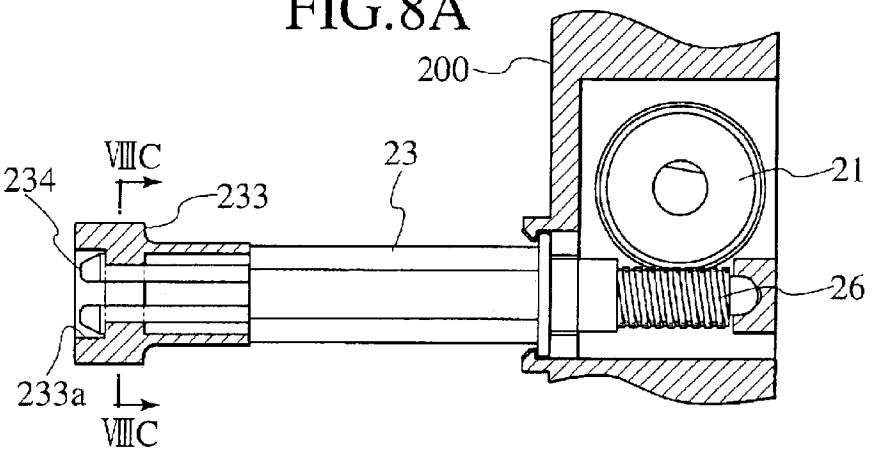
FIGS. 8A to 8D illustrate the other torque limiter used for the connector of FIG. 1.
Figure 8B:
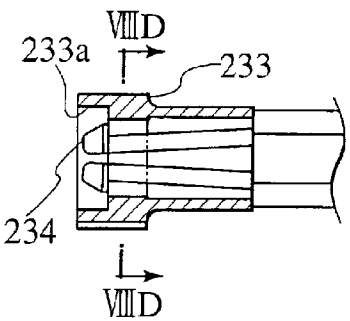
Figure 8C:
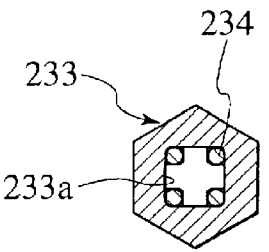
Figure 8D:
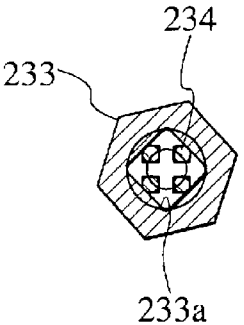

In FIG. 8A, relief nut 233 is fixed to a tip of operation part 23.

The end of operation part 23 includes relief nut 233 having rectangular hole 233*a*. Hole 233*a* has four flexible bars 234 set at its four corners. Bar 234 has a roughly rectangular sectional shape.

When the torque wrench N applies small rotation torque to the nut 233, the rotation torque is transmitted to worm 26. Rotation torque exceeding a predetermined value bends bar-shaped part 234 inward, and the nut 233 runs idly. Nontransmission of rotation torque of the predetermined value or higher applies no excessive forces on worm 26 and worm wheel 21, and prevents damage of the respective portions.

(Second Embodiment)

A second embodiment includes a lever in place of operation part 23. Other parts are similar to those of the first embodiment. Similar members are denoted by similar reference numerals, and description thereof will be omitted.

Figure 9A:
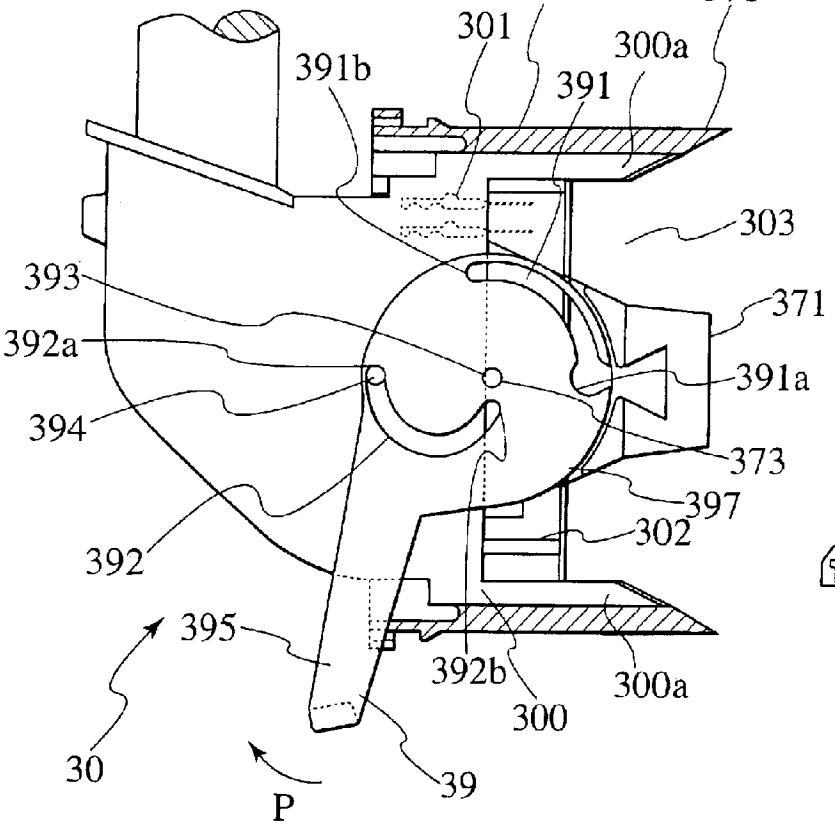
FIGS. 9A to 9C illustrate a connector connected to a modular instrument according to a second embodiment of the present invention.
Figure 9B:
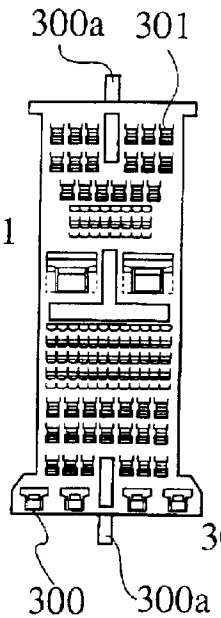
Figure 9C:
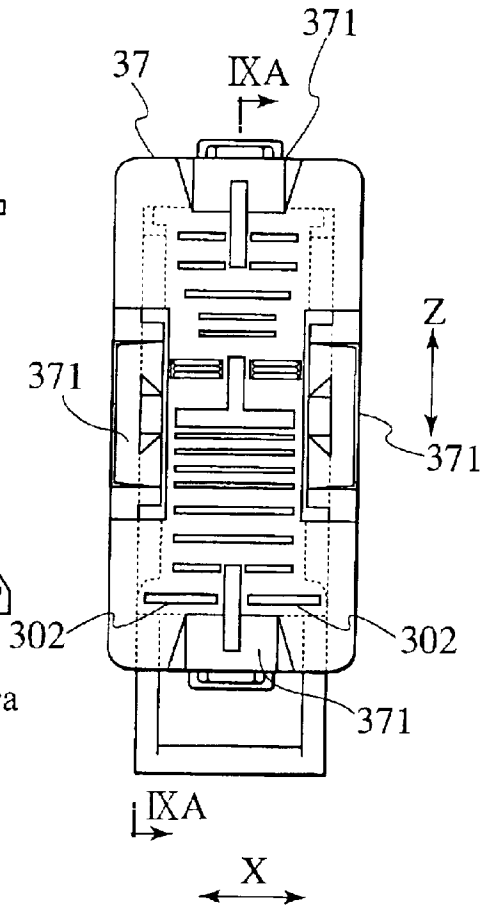

In FIGS. 9A to 9C, locator 37 includes rotatably supported lever 39. Lever 39 includes base board 397 equivalent to guide 25 of the first embodiment. Base board 397 includes operation handle 395. Base board 397 has cam channel 391 engaged with lock pin 102 of connector 10. Base board 397 has cam channel 329 engaged with guide pin 394 fixed to housing 300. Groove 329 and pin 394 move housing 300 toward connector 10 with respect to locator 37.

Lever 39 has center hole 393 at its rotation center. This hole 393 rotatably supports a center pin of locator 37. Lever 39 has circular-arc cam channel (cut-out) 391 with an angle. Lever 39 has circular-arc cam channels (slots) 392 at the identical angle, which is provided with a pair of ends 392*a*, 392*b*. One end 392*a* is located in a peripheral edge of lever 39. The other end 392*b* is located near hole 393. Clockwise (P direction) rotation of handle 395 moves pin 394 from end 392*a* to end 392*b* in groove 39. This moves housing 300 to connector 10 with respect to locator 37. Internal terminal 301 is received in housing 300.

First, lever 39 elastically deforms base board 397 inside, and inserts it into locator 37. Then, lever 39 releases the elastic deformation to engage center hole 393 with pin 373. This engagement locates lever 39 centered on locator 37 as a buffer. Next, housing 300 is inserted from the rear side between both base boards 397 of lever 37. Pin 394 widens a thin part formed near an outer end of cam channel 392 of base board 397. Pin 394 is engaged with cam channel 392. By this engagement, Lever 39 prevents the coming-off of housing 300 from locator 37.

Plate tab guide 302 is disposed integrally with locator 37 in the front face of internal terminal 301 of a recess of a modular instrument. Guide 302 defines a hole penetrated by internal terminal 301. Guide 302 guides internal terminal 301 while connector 40 and connector 30 are mated together. Guide 302 prevents damage of internal terminal 301 in component conveyance.

Figure 10A:
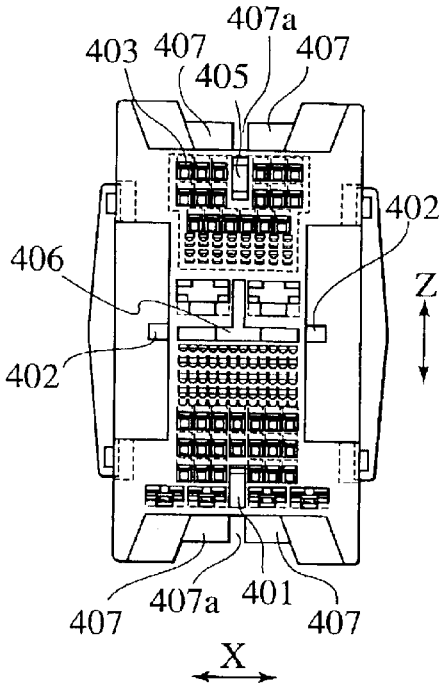
FIGS. 10A and 10B illustrate a connector connected to a vehicle body according to the second embodiment of the present invention.
Figure 10B:
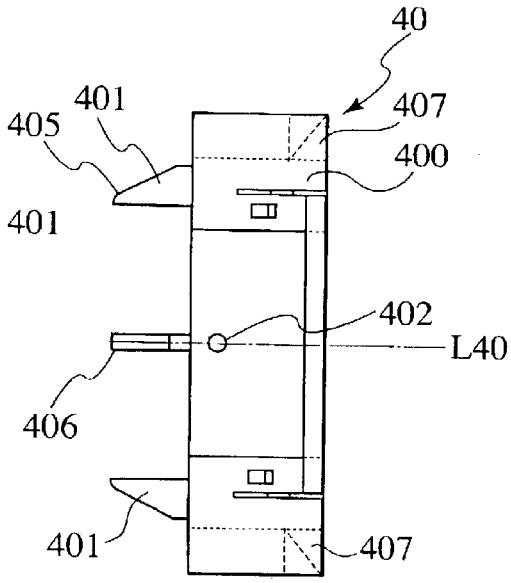

In FIGS. 10A and 10B, connector 40 includes housing 400. Connector 40 includes auxiliary locating pins 401, 406 in the front face of housing 400. Pin 401 has oblique face 405 inclined with respect to an axis line L40. Connector 40 includes flanges 407 at the top and bottom. Flanges 407 include gaps 407*a* between flanges 407.

A mating operating of connectors 30, 40 will be described.

Figure 11:
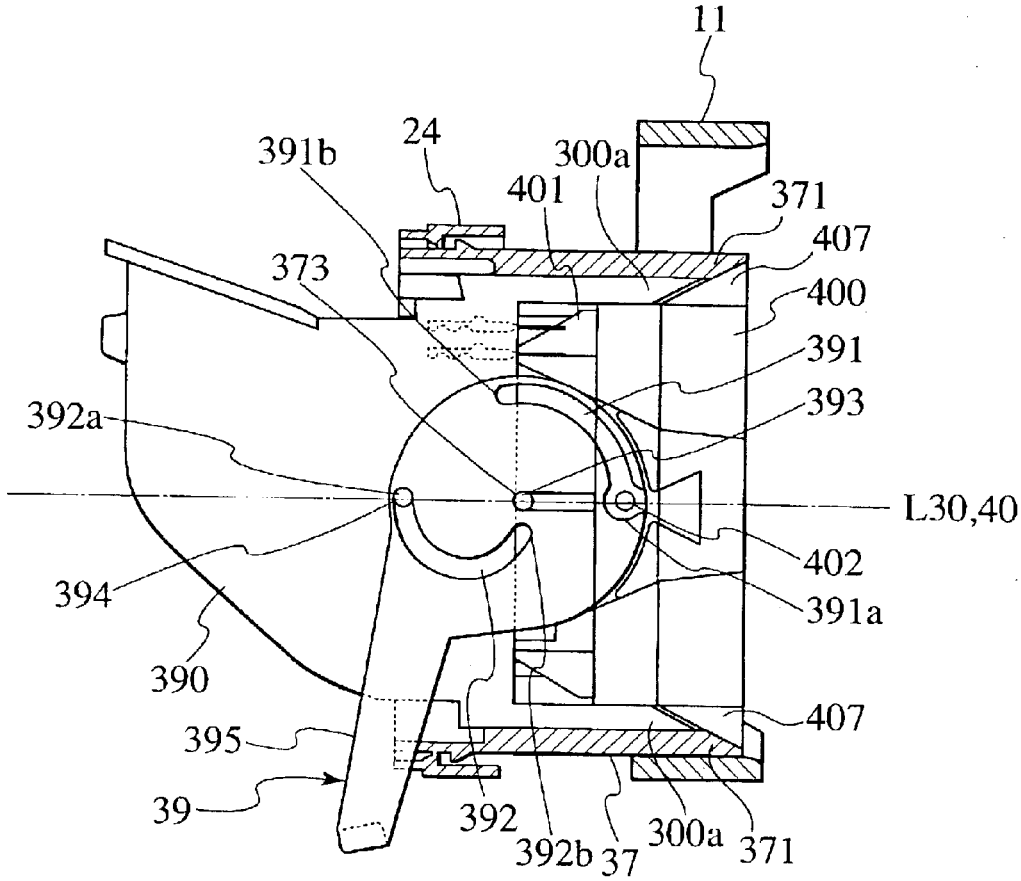
FIG. 11 is an illustrative view of a mating operation of the connectors of FIGS. 10A and 10B.

In FIG. 11 equivalent to FIG. 4B, the modular instrument is in a temporarily held state where loading (attaching) on a vehicle body is completed. Auxiliary locating pins 401, 406 start mating into a recess (not shown) of housing 300. Lock pin 402 is received in open end 391*a* of cam channel 391. The ends 371 of locator 37 abut against flanges 407.

Figure 12:
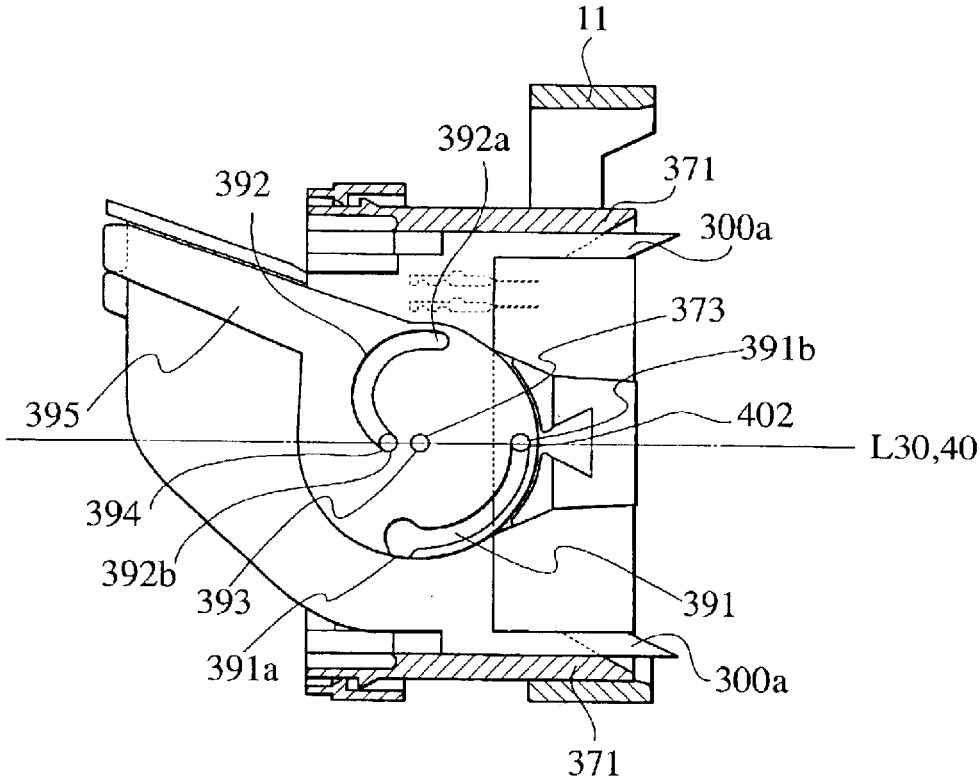
FIG. 12 is an illustrative view of mating completion of the connector of FIGS. 10A and 10B.

Lever 39 of FIG. 11 is rotated around pin 373. During this rotation, cam channel 391 restrains pin 401 at a position in axial directions (L20, L40). In FIG. 12 corresponding to FIG. 4C, pin 394 is guided by groove 392. The ends 300*a* of connector 300 pass through gaps 407*a* between flanges 407. Pin 394 approaches pin 393 in the axial direction. Accordingly, connector 30 is moved in the axial direction with respect to locator 37 to approach connector 40. Engagement between groove 391 and pin 402 allows connector 40 to be stationary in the axial direction with respect to locator 37 during the rotation of lever 39. Thus, connectors 30, 40 are completely mated together to completely mate housing 300 and connector 40 with each other. Pins 401, 406 are fitted in a mating hole of guide 302. Internal terminal 301 is guided by guide 302 to move forward through the hole of guide 302, and then be mated with the external terminal in connector 40.

In FIG. 11, in connector 40, the eternal terminal and the internal terminal received in connector 30 are not yet mated together. Housing 400 fits in recess 303 of housing 300, and parallel faces thereof having predetermined dimensions in the axial direction are mated to each other. No undue moment is applied on the internal and external terminals by a force of harness elastic deformation or tensile stress. Even if undue forces are applied for alignment of connectors 30, 40 during loading on the modular instrument, no undue moment is applied on the internal and external terminals. Thus, no terminal contact failures occur. During mating of the external and internal terminals, the internal terminal is guided by guide 302 to move forward through the hole of the guide 302. Thus, both terminals are smoothly mated.

According to the self-locating connector assembly, during mating of the first connector and the second connector, before the internal terminal and the external terminal start to be mated with each other, the first connector and the second connector are mated on the axial parallel faces of a predetermined dimension. The mating corrects a displacement between axes of first and second connectors. Thus, a force by elastic deformation of the harness or tensile stress causes no undue moment on internal and external terminals. When an undue force is applied to the first and second connectors for alignment during equipment on the modular instrument, no undue moment is applied to the internal and external terminals, and thus no terminal contact failures occur.

This needs no correction of alignment, thus achieving higher workability and reliability in connection of the connectors.

According to the connector assembly, automatic correction of the displacement is completed, with equipping of modular instrument on the vehicle body completed. Next, the terminals starts to be mated with each other. This causes no stress and no damage on the terminals during equipping of a modular instrument on a vehicle body.

According the invention, rotating of a rotation operating part worm and worm wheel allows the first connector and the second connector to be mated with each other. This facilitates mating operation of the connectors and allows mating operation in a direction parallel with an axial direction of terminals, thus achieving higher workability and reliability in connection of the connectors.

According to the invention, the lever with rotating operation allows the first connector and the second connector to be mated with each other. This needs no tool and allows secure mating operation in a direction parallel with an axial direction of terminals, thus achieving higher workability and reliability in connection of the connectors.

According to the invention, the rotation stopping mechanism provided to the rotation operating part prevents rotating of the rotation operating part. This applies no excessive force to the worm and worm wheel, achieving no damage on respective parts.

According to the invention, the torque limiter provided to the rotation operating part restricts a rotary force of the rotation operating part. This applies no excessive force to the worm and worm wheel, achieving no damage on respective parts.

According to the invention, the guide plate, integral with the locator, defines a hole in front of an internal terminal of the first connector for passing the internal terminal through the hole. During the mating of the first and second connectors, the internal terminal is guided by the guide plates. The guide allows smoothly mating of the internal and external terminals with each other. This achieves higher workability and reliability in connection, and prevents damage on the terminals during conveying of components.

The entire contents of Japanese Patent Applications P 2002-65537 (filed on Mar. 11, 2002) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A self-locating connector assembly comprising:

a first connector;

a second connector comprising a guide pin and being configured to mate with the first connector, the first connector comprising:

a worm;

a worm wheel; and a cam channel for engaging with the guide pin to drive the first connector toward the second connector; and a locator configured to facilitate aligning the first connector and the second connector, wherein a rotation of the worm and worm wheel allows the first connector and the second connector to mate.

2. A self-locating connector assembly comprising:

a first connector having one of internal and external terminals;

a second connector having the other of the external and internal terminals; and a locator configured to slidably receive the first connector, wherein each of the internal and external terminals has an axis, wherein an alignment of the axes of the internal and external terminals defines an axial direction, wherein the locator is configured to receive the first connector in the axial direction, wherein the first connector and the second connector are configured to be initially and slidably locked with respect to corresponding supporting members both vertically and horizontally, before the first and second connectors are mated with each other, wherein the first connector comprises a recess, the recess including at least one oblique face configured to facilitate mating the first connector with the second connector, the recess including at least a pair of parallel faces, wherein the second connector comprises at least one face, wherein each of the faces of the second connector corresponds to one of the parallel faces of the recess of the first connector, wherein during a mating operation of the first connector and the second connector the parallel faces of the first connector and the corresponding faces of the second connector are configured to correct any misalignment of the first and second connectors, before the internal and external terminals are mated with each other, wherein the second connector comprises a guide pin, wherein the first connector comprises:

a worm;

a worm wheel; and a cam channel for engaging with the guide pin to drive the first connector toward the second connector, and wherein a rotation of the worm and worm wheel allows the first connector and the second connector to mate.

3. The self-locating connector assembly according to claim 2, wherein each of the supporting members is mounted to a vehicle body and a modular instrument.

4. The self-locating connector assembly according to claim 2, wherein the first connector comprises lock pin, wherein the locator comprises a lever rotatably supported thereto which is configured to engage the worm, and wherein the lever comprises a first cam channel for engaging with the lock pin, and second cam channel for engaging with the guide pin.

5. The self-locating connector assembly according to claim 2 wherein the first connector comprises a connector housing, wherein the locator comprises:

a rotation operating part for rotating the worm; and a rotation stopping mechanism configured to prevent the worm wheel from rotating beyond a predetermined number of rotations, and wherein the stopping mechanism comprises:

a projection mounted to the rotation operating part; and a movable stopper mounted to the connector housing.

6. The self-locating connector assembly according to claim 5, wherein the rotation operating part comprises a torque limiter.

7. The self-locating connector assembly according to claim 2, wherein the locator comprises a guide plate integral therewith, and wherein the guide plate defines a hole in front of an internal terminal of the first connector for passing the internal terminal through the hole.

8. The self-locating connector assembly according to claim 2, wherein the locator is configured to facilitate aligning the first connector and the second connector.

9. The self-locating connector assembly according to claim 8, wherein the locator comprises an end face inclined to an axis.

10. The self-locating connector assembly according to claim 8, wherein the first connector is displacable within the locator, wherein the first connector comprises a guide having a cam channel configured to facilitate bringing the first and second connectors together.

11. The self-locating connector assembly according to claim 10, wherein as the cam channel travels from a starting point to a terminal point, the guide brings the axes of the internal and external terminals into alignment.

* * * * *